US007019657B2

(12) United States Patent
Lovell et al.

(10) Patent No.: US 7,019,657 B2
(45) Date of Patent: Mar. 28, 2006

(54) METHOD, APPARATUS AND SYSTEM FOR FIRE DETECTION

(75) Inventors: Michael Lovell, Toronto (CA); David R. Lovell, Toronto (CA)

(73) Assignee: Virtual Context Inc., Toronto (CA)

( * ) Notice: Subject to any disclaimer, the term of this patent is extended or adjusted under 35 U.S.C. 154(b) by 0 days.

(21) Appl. No.: 10/732,473

(22) Filed: Dec. 11, 2003

(65) Prior Publication Data

US 2005/0110633 A1 May 26, 2005

(30) Foreign Application Priority Data

Nov. 24, 2003 (CA) ..... 2450518

(51) Int. Cl.
*G08B 17/10* (2006.01)

(52) U.S. Cl. ..... 340/632; 73/23.2

(58) Field of Classification Search ..... 340/632, 340/628, 629, 630, 286.05; 73/23.2, 23.25
See application file for complete search history.

(56) References Cited

U.S. PATENT DOCUMENTS 5,659,292 A * 8/1997 Tice ..... 340/522
5,691,704 A * 11/1997 Wong ..... 340/628
5,841,021 A * 11/1998 De Castro et al. ..... 73/23.2
6,107,925 A * 8/2000 Wong ..... 340/628
6,166,647 A * 12/2000 Wong ..... 340/628

* cited by examiner

*Primary Examiner*—Phung T. Nguyen
(74) *Attorney, Agent, or Firm*—Gowling Lafleur Henderson LLP; Grant W.C. Tisdall

(57) ABSTRACT

An apparatus for detecting and indicating the presence of combustion products comprising a first combustion product monitor for monitoring for the presence of a first combustion product and quantifying said first product; a second combustion product monitor for monitoring for the presence of a second combustion product and quantifying said second product; and, an alarm connected to the first and second combustion product monitors for triggering an alarm when an alarm condition is satisfied, said alarm condition being at least one of the group consisting of the quantified presence of the first combustion product exceeding a first-product threshold level and the quantified presence of the second combustion product exceeding a first second-product threshold level; and, the quantified presence of the second combustion product exceeding a second second-product threshold level.

24 Claims, 9 Drawing Sheets

METHOD, APPARATUS AND SYSTEM FOR FIRE DETECTION

This application claims priority from a previously filed Canadian Patent Application Serial No. 2,450,518, filed Nov. 24, 2003.

The present invention relates to a method, apparatus and system for fire detection. In particular, the present invention relates to a method, apparatus and system for fire detection having a plurality of sensory inputs.

BACKGROUND OF THE INVENTION

Annually, fires are responsible for extensive property damage and loss of life. Various fire detection systems have been employed in an attempt to reduce the extent of property damage and the likelihood of loss of life.

Residential buildings are often equipped with fire detectors that use one type of sensing method to detect for the presence of fire. For example, a smoke detector employing an ionization sensor may trigger an alarm if the sensor detects an increase in the density of air borne particulate matter. Ionisation sensors are known to have a high rate of false positive readings in the presence of dust and cooking vapours in particular. As a result, smoke detectors of this type are often disabled, thereby increasing the risk of property damage and loss of life.

Some fire detector systems, such as described in Weimeyer (U.S. Pat. No. 5,726,633), employ two sensors and as such two sensory inputs to detect for the presence of fire. However, these systems often employ complex algorithms (such as fuzzy logic) and microprocessor technology to process the sensory inputs to determine when an alarm condition has occurred. As a result, solutions of this type are often unnecessarily complex and expensive for sensing fire in residential settings.

There remains a need for a simple, low cost system, method and apparatus for detecting fire and the products of combustion.

SUMMARY OF THE INVENTION

The present invention provides a method for detecting and indicating the presence of combustion products comprising the steps of monitoring for the presence of a first combustion product and quantifying said first product; monitoring for the presence of a second combustion product and quantifying said second product; and, triggering an alarm when an alarm condition is satisfied, said alarm condition being at least one of the group consisting of the quantified presence of the first combustion product exceeding a first-product threshold level and the quantified presence of the second combustion product exceeding a first second-product threshold; and, the quantified presence of the second combustion product exceeding a second second-product threshold.

In an alternate embodiment, the present invention provides a method for detecting and indicating the presence of combustion products comprising the steps of monitoring for the presence of a combustion gas and quantifying the combustion gas; monitoring for the presence of an air borne particulate matter and quantifying the air borne particulate matter; measuring an ambient temperature and quantifying a change in the ambient temperature; and, triggering an alarm when an alarm condition is satisfied, said alarm condition being at least one of the group consisting of the quantified presence of the combustion gas exceeding a threshold combustion gas level and the quantified presence of the air borne particulate matter exceeding a first threshold air borne particulate matter level; the quantified presence of the air borne particulate matter exceeding a second threshold air borne particulate matter level; and, the quantified rate of change in the ambient temperature exceeding a threshold temperature change level.

The first combustion product may be a combustion gas, selected from the group consisting of CO, $CO_2$, HCN, HCl, $SO_x$, $NO_x$, and combinations thereof.

The second indicator of combustion may be air borne particulate matter, such as smoke particles.

The present invention also provides a system for detecting and indicating the presence of combustion products comprising a first combustion product monitor for monitoring for the presence of a first combustion product and quantifying said first product; a second combustion product monitor for monitoring for the presence of a second combustion product and quantifying said second product; and, an alarm in communication with the first and second combustion product monitors for triggering an alarm when an alarm condition is satisfied, said alarm condition being at least one of the group consisting of the quantified presence of the first combustion product exceeding a first-product threshold level and the quantified presence of the second combustion product exceeding a first second-product threshold level; and, the quantified presence of the second combustion product exceeding a second second-product threshold level.

In an alternate embodiment, the present invention provides a system for detecting and indicating the presence of combustion products comprising a combustion gas monitor for monitoring for the presence of a combustion gas and quantifying the combustion gas; an air borne particulate matter monitor for monitoring for the presence of an air borne particulate matter and quantifying the air borne particulate matter; a temperature monitor for measuring an ambient temperature and quantifying a rate of change for the ambient temperature; and, an alarm in communication with the combustion gas monitor, air borne particulate matter monitor and temperature monitor for triggering an alarm when an alarm condition is satisfied, said alarm condition being at least one of the group consisting of the quantified presence of the combustion gas exceeding a threshold combustion gas level and the quantified presence of the air borne particulate matter exceeding a first threshold air borne particulate matter level; the quantified presence of the air borne particulate matter exceeding a second threshold air borne particulate matter level; and, the quantified rate of change in the ambient temperature exceeding a threshold temperature change level.

The first-product monitor may be a micro-electronic gas sensor.

The second-product monitor may be a photo-electric particle detector.

The present invention further provides an apparatus for detecting and indicating the presence of combustion products comprising a first combustion product monitor for monitoring for the presence of a first combustion product and quantifying said first product; a second combustion product monitor for monitoring for the presence of a second combustion product and quantifying said second product; and, an alarm connected to the first and second combustion product monitors for triggering an alarm when an alarm condition is satisfied, said alarm condition being at least one of the group consisting of the quantified presence of the first combustion product exceeding a first-product threshold level and the quantified presence of the second combustion product exceeding a first second-product threshold level;

and, the quantified presence of the second combustion product exceeding a second second-product threshold level.

In an alternate embodiment, the present invention provides an apparatus for detecting and indicating the presence of combustion products comprising a combustion gas monitor for monitoring for the presence of a combustion gas and quantifying the combustion gas; an air borne particulate matter monitor for monitoring for the presence of an air borne particulate matter and quantifying the air borne particulate matter; a temperature monitor for measuring an ambient temperature and quantifying a rate of change for the ambient temperature; and, an alarm connected to the combustion gas monitor, air borne particulate matter monitor and temperature monitor for triggering an alarm when an alarm condition is satisfied, said alarm condition being at least one of the group consisting of the quantified presence of the combustion gas exceeding a threshold combustion gas level and the quantified presence of the air borne particulate matter exceeding a first threshold air borne particulate matter level; the quantified presence of the air borne particulate matter exceeding a second threshold air borne particulate matter level; and, the quantified rate of change in the ambient temperature exceeding a threshold temperature change level.

BRIEF DESCRIPTION OF THE DRAWINGS

These and other features of the preferred embodiments of the invention will become more apparent in the following detailed description in which reference is made to the appended drawings wherein.

DESCRIPTION OF THE PREFERRED EMBODIMENTS

Figure 1:
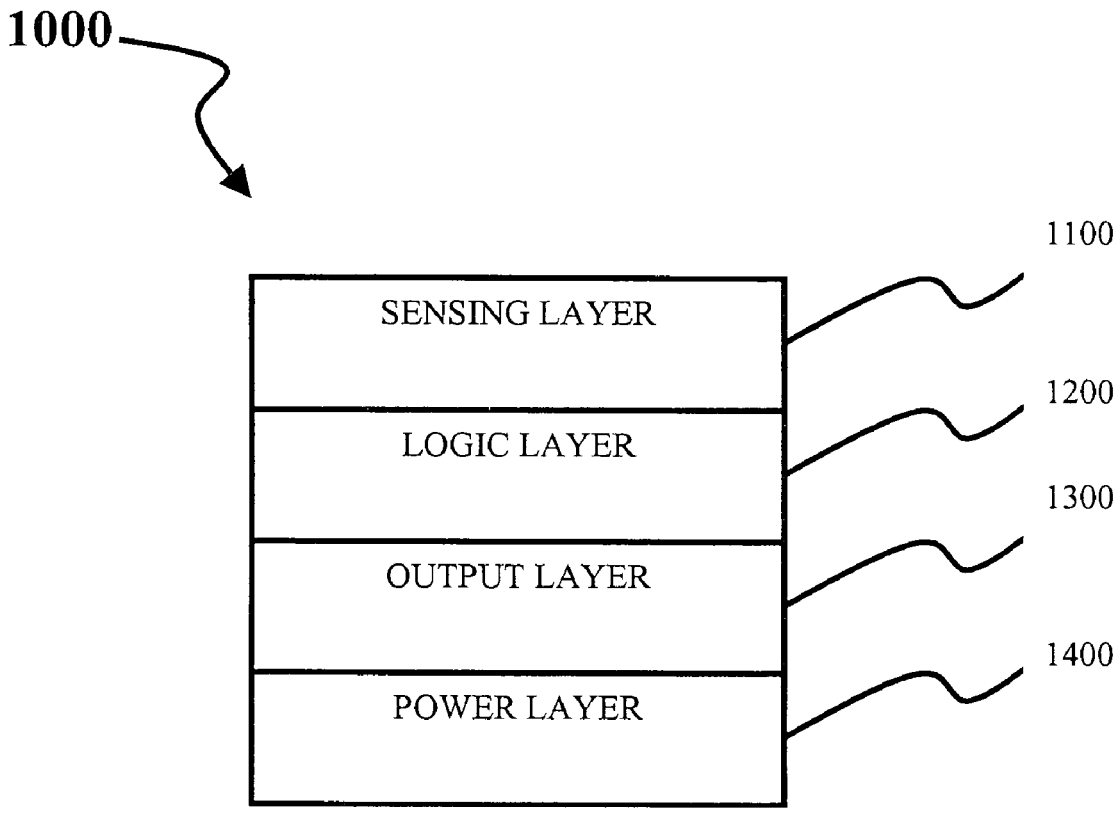
FIG. 1 is a schematic drawing of the architecture of a fire detector according to an embodiment of the present invention.

Referring to FIG. 1, a schematic representation of the architecture 1000 of a fire detector according to a preferred embodiment of the present invention is illustrated. The fire detector includes a sensing layer 1100, a logic layer 1200, an output layer 1300 and a power layer 1400.

In a first embodiment, the sensing layer 1100 consists of opto-electronic and electronic devices that detect and quantify the presence of air borne particulate matter, such as smoke particles, and specific gases of combustion, such as $CO_2$, CO, HCN, HCl, $SO_X$, $NO_X$ and combinations thereof. In a preferred embodiment of the present invention, the sensing layer 1100 further includes a thermal sensor to detect and quantify any change in the ambient temperature. The thermal sensor is preferably a thermistor.

The logic layer 1200, in a preferred embodiment, uses electronic circuitry to prioritize the sensory outputs of the sensing layer 1100. The sensory outputs of the sensing layer 1100 are assessed to determine whether the conditions that indicate the presence of a fire have been satisfied. The logic layer 1200 uses electronic circuitry to prioritize the sensory outputs of the sensing layer 1100.

The output of the logic layer 1200 is sent to the output layer 1300. If the conditions that indicate the presence of a fire have been satisfied, the output layer 1300 activates an alarm indicating the presence of a fire. The alarm may be a visual alarm, such as flashing lights, an audible alarm, such as a siren, or any combination of audio and visual outputs that may indicate to an individual that the fire detector has detected a fire.

The fire detector is powered by the power layer 1400, which delivers electrical power to the components of the sensing layer 1100, logic layer 1200 and output layer 1300. The power layer 1400 may be energized by alternating current voltages and direct current power.

Figure 2:
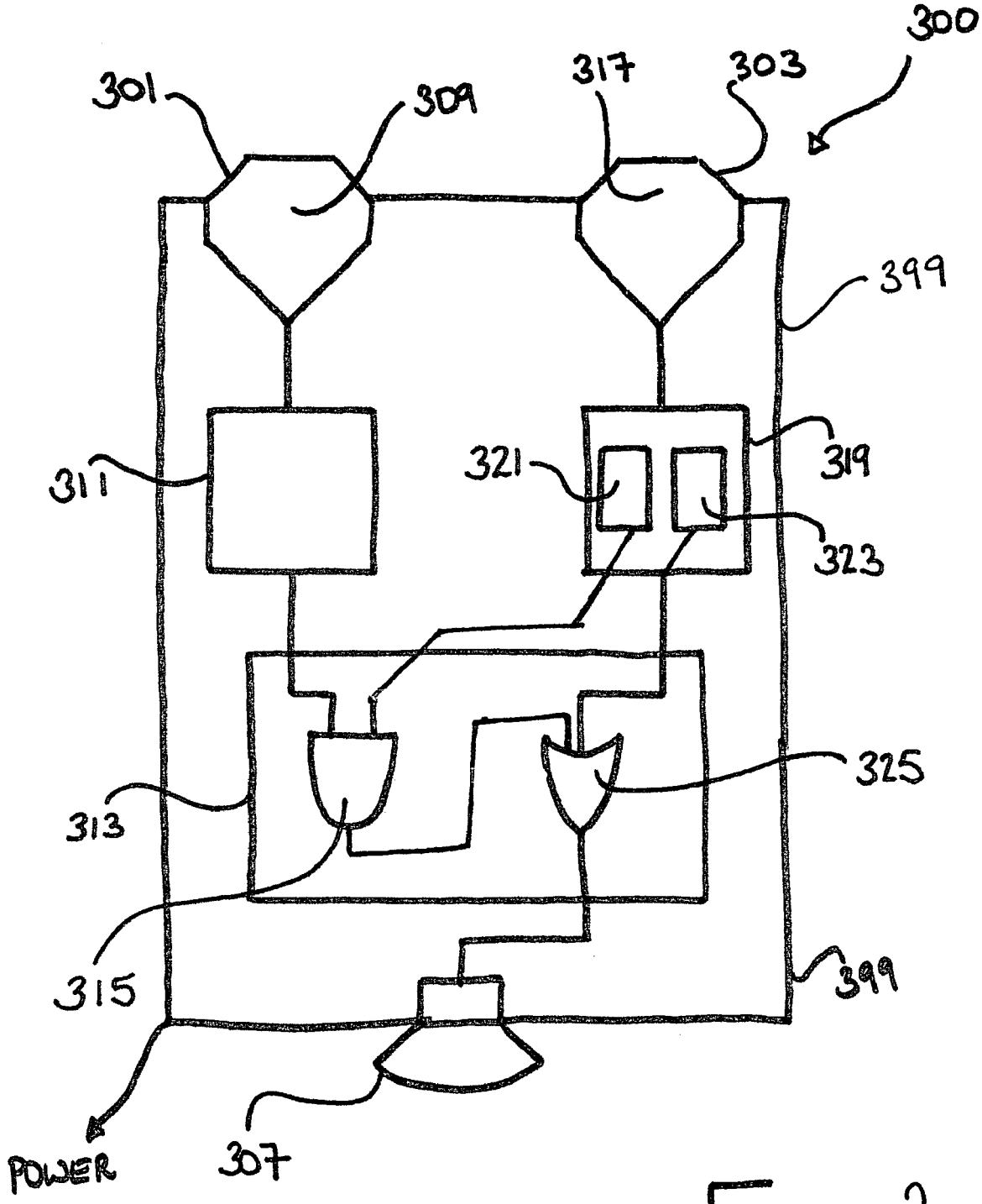
FIG. 2 is a schematic drawing of an apparatus for detecting the presence of fire and products of combustion according to an embodiment of the present invention.

Referring to FIG. 2, an apparatus 300 for detecting and indicating the presence of combustion products according to a preferred embodiment of the present invention is illustrated. The apparatus 300 is comprised of a first combustion product monitor 301, which monitors for the presence of a first combustion product and quantifies the first product. In a preferred embodiment, the first combustion product monitor is a combustion gas monitor 301 for monitoring for the presence of a combustion gas and quantifying the combustion gas. The apparatus 300 is also comprised of a second combustion product monitor 303, which monitors for the presence of a second combustion product and quantifies the second product. In a preferred embodiment, the second combustion product monitor 303 is an air borne particulate matter monitor 303 for monitoring for the presence of an air borne particulate matter and quantifying the air borne particulate matter. An alarm 307 is connected to and in communication with the combustion gas monitor 301 and air borne particulate matter monitor 303 for triggering an alarm response when an alarm condition is satisfied.

The combustion gas monitor 301 may be a micro-electronic gas sensor 309, as is known to those skilled in the art, such as the F-2 CO sensor, as manufactured by Teledyne Analytical Instruments of City of Industry, California USA. In a preferred embodiment, the micro-electronic gas sensor 309 is the model TGS 203 as manufactured by Figaro USA Inc. of Glenview, Ill. USA, but any gas sensor known to those skilled in the art that is able to monitor for the presence of and quantify a combustion gas may be employed. The combustion gas may be selected from the group consisting of CO, $CO_2$, HCN, HCl, $SO_x$, $NO_x$, and combinations thereof. In a preferred embodiment, the selected combustion gas is CO.

The gas sensor 309 monitors for the presence of the selected combustion gas and quantifies the level of the selected gas. In the present embodiment, the gas sensor 309 quantifies the concentration of the selected gas. The gas sensor 309 measures a change in electrical resistance, that is proportional to the concentration of the gas being detected, to generate a voltage signal. In an alternate embodiment, the gas sensor 309 measures optical absorption or transmission at one or more optical wavelengths to generate a voltage signal that is proportional to the concentration of the gas being detected. In a preferred embodiment, the gas sensor 309 measures the change in electrical resistance to generate a voltage signal proportional to the concentration of the gas being detected.

The gas sensor 309 generates a signal that corresponds to the quantified level of the selected gas. The generated signal may be a digital or analog indicator of the selected gas level. In a preferred embodiment, the generated signal is a gas voltage signal corresponding to the quantified gas level, which is sent to a gas comparison stage 311. The gas comparison stage 311 determines if the generated signal exceeds a threshold gas level; in the present embodiment, if the received gas voltage signal exceeds a threshold gas level. In a preferred embodiment, the gas comparison stage 311 is an analog comparator of the type known to those skilled in the art. In alternate embodiments of the present invention, the comparison stage 311 may be a digital comparator, an operation amplifier that filters or amplifies an input signal and generates an output signal from only a subset of possible inputs, or a logic device operating under a programmed control, such as a microprocessor, compact programmable logic device or a field programmable gate array. Any other means known to those skilled in the art that can receive an input signal that corresponds to the quantified level of the selected gas, compare the input signal to a reference value corresponding to a gas concentration above a threshold level and generate an output signal if a threshold condition is satisfied may be employed.

If the quantified gas level exceeds the threshold gas level, the generated gas voltage signal is sent to a signal combiner 313. The signal combiner 313 is configured to receive and combine signals generated by the combustion gas monitor 301 and the air borne particulate matter monitor 303 and to determine if an alarm condition has been satisfied. In a preferred embodiment of the present invention, the gas signal is sent to an AND logic gate 315 of the combiner 313.

The air borne particulate matter monitor 303 monitors for the presence of air borne particulate matter. In a preferred embodiment, the air borne particulate matter is smoke particles.

The air borne particulate matter monitor 303 may be a photo-electric particle detector 317, as is known to those skilled in the art, that incorporates an emitter, such as model IRLED-E23 or IRLED-E24 manufactured by Gilway Technical Lamp, and a detector, such as model PDB-C134 (F) manufactured by Photonic Detectors Inc. of Simi Valley, Calif., USA. In a preferred embodiment the photoelectric detector 317 incorporates an emitter model PDI-E808 and a detector model PDB-C134 (F) both manufactured by Photonic Detectors Inc. of Simi Valley, Calif., USA, but any air borne particulate matter monitor known to those skilled in the art that is able to monitor for the presence of and quantify the level of air borne particulate matter may be employed.

The photoelectric particle detector 317 monitors for the presence of the selected air borne particulate matter and quantifies the level of the selected matter. In a preferred embodiment, the photo-electric particle detector 317 quantifies the concentration and density of the smoke particles.

The particle detector 317 generates a signal that corresponds to the measured level of the selected air borne particulate matter. The generated signal may be a digital or analog indicator of the air borne particulate matter level. In a preferred embodiment, the generated signal is a particle voltage signal corresponding to the air borne particulate matter level, which is sent to a particle comparison stage 319. The particle comparison stage 319 includes a "low" particle comparison stage 321 and a "high" particle comparison stage 323, each of which receive the particle voltage signal. The "low" particle comparison stage 321 determines if the received particle voltage signal exceeds a "low" particle threshold level and the "high" particle comparison stage 323 determines if the particle voltage signal exceeds a "high" particle threshold level.

In a preferred embodiment, the particle comparison stage 319 is an analog comparator of the type known to those skilled in the art. In alternate embodiments of the present invention, the particle comparison stage 319 may be a digital comparator, an operation amplifier that filters or amplifies an input signal and generates an output signal from only a subset of possible inputs, or a logic device operating under a programmed control, such as a microprocessor, compact programmable logic device or a field programmable gate array. Any other means known to those skilled in the art that can receive an input signal that corresponds to the quantified level of the selected particle, compare the input signal to a reference value corresponding to a threshold particle level and generate an output signal if a threshold condition is satisfied may be employed.

If the quantified air borne particulate matter level exceeds the "low" particle threshold, the generated "low" particle voltage signal is sent to the combiner 313. In a preferred embodiment of the present invention, the "low" particle voltage signal is sent to the AND logic gate 315 of the combiner 313. If the quantified air borne particulate matter level exceeds the "high" particle threshold level, the generated "high" particle voltage signal is sent to the combiner 313. In a preferred embodiment of the present invention, the "high" particle voltage signal is sent to a OR logic gate 325 of the combiner 313.

The signal combiner 313 is configured to receive signals from the gas comparison stage 311 and particle comparison stage 319, respectively. The AND logic gate 315 is configured to receive signals from the gas comparison stage 311 when the gas comparison stage 311 determines that the gas threshold level has been exceeded. The AND logic gate 315 is also configured to receive signals from the "low" particle comparison stage 321 when the "low" particle comparisons stage 321 determines that the "low" particle threshold level has been exceeded.

The OR logic gate 325 is connected to and in communication with the AND logic gate 315 and is also connected to and configured to receive signals from the "high" particle comparison stage 323 when the "high" particle comparison stage 323 determines that the "high" particle threshold level has been exceeded.

The OR logic gate 325 is further connected to the alarm 307, which is triggered when an alarm condition is satisfied, the alarm condition being satisfied when at least one of the following occurs:

(a) the quantified presence of the combustion gas exceeds the combustion gas threshold level and the quantified presence of the air borne particles exceeds the "low" particle threshold level (i.e., a first threshold air borne particulate matter level); and, (b) the quantified presence of the air borne particles exceeds the "high" particle threshold level (i.e., a second threshold air borne particulate matter level).

In the event that the first alarm condition (a) is satisfied, an alarm signal is sent from the AND logic gate 315, through the OR logic gate 325, to the alarm 307, at which point an alarm signal is generated indicating the presence of a fire. In a preferred embodiment of the present invention, the AND logic gate 315 communicates a voltage signal to the alarm 307.

In the event that the second alarm condition (b) is satisfied, an alarm signal is sent from the OR logic gate 325 to the alarm 307, at which point an alarm signal is generated indicating the presence of a fire. In a preferred embodiment of the present invention, the first OR logic gate 325 communicates a voltage signal to the alarm 307.

In a preferred embodiment, the first combustion monitor 301, second combustion monitor 303, alarm 307, comparison stage 311 and combiner 313 are mounted in a housing 399. The housing 399 includes access points, which provide the monitors 301 and 303 with access to the outside environment in order to monitor for the presence of the first and second combustion products, respectively.

Figure 3:
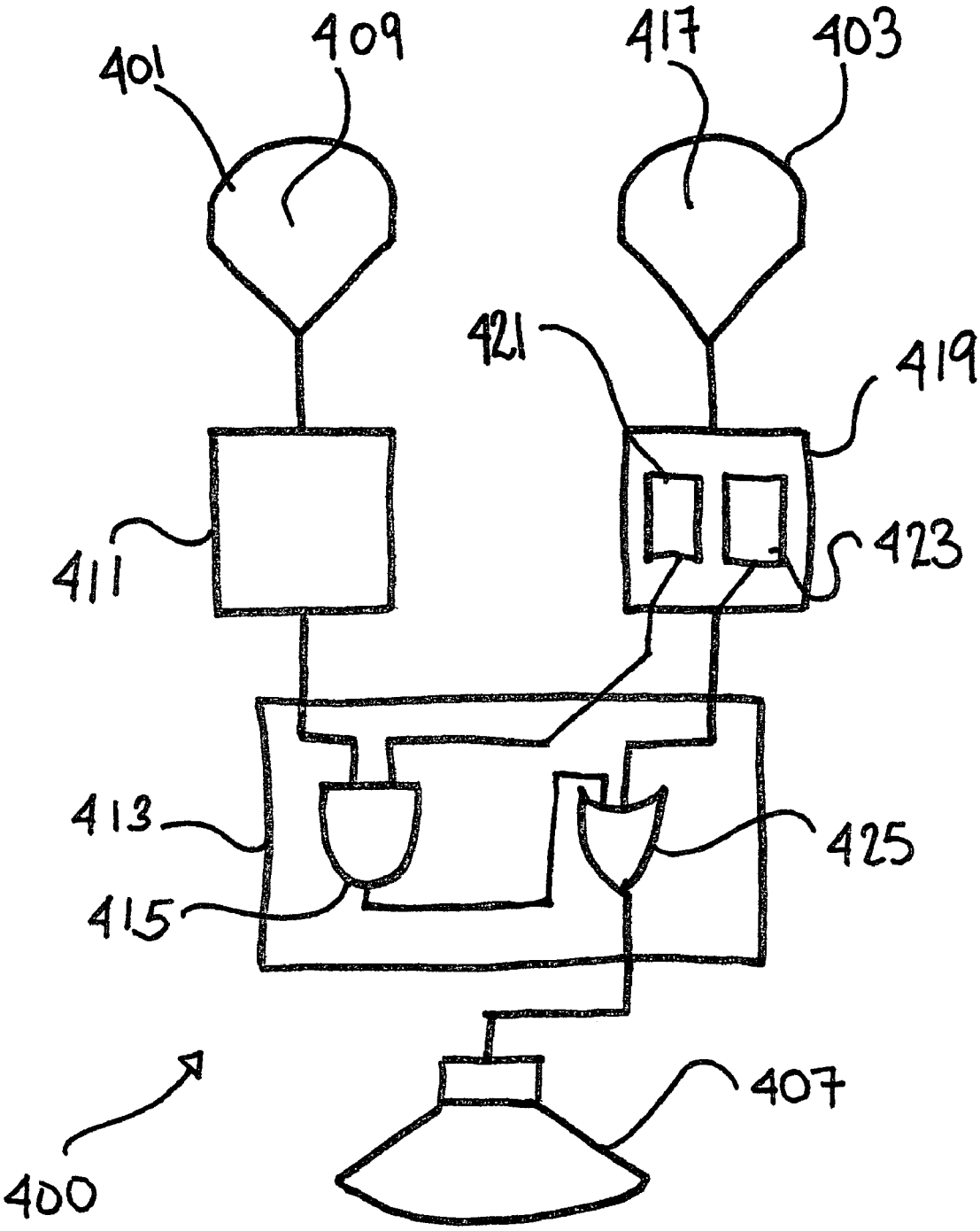
FIG. 3 is a schematic drawing illustrating a system for detecting and indicating the presence of combustion products according to an embodiment of the present invention.

Referring to FIG. 3, a system 400 for detecting and indicating the presence of combustion products according to an embodiment of the present invention is illustrated. The system 400 is comprised of a first combustion product monitor 401, which monitors for the presence of a first combustion product and quantifies the first product. In a preferred embodiment, the first combustion product monitor 401 is a combustion gas monitor 401 for monitoring for the presence of a combustion gas and quantifying the combustion gas. The system 400 is also comprised of a second combustion product monitor 403, which monitors for the presence of a second combustion product and quantifies the second product. In a preferred embodiment, the second combustion product monitor 403 is an air borne particulate matter monitor 403 for monitoring for the presence of an air borne particulate matter and quantifying the air borne particulate matter. An alarm 407 is in communication with the combustion gas monitor 401 and the air borne particulate matter monitor 403 for triggering an alarm response when an alarm condition is satisfied.

The combustion gas monitor 401 may be a micro-electronic gas sensor 409, as is known to those skilled in the art, such as the F-2 CO sensor, as manufactured by Teledyne Analytical Instruments of City of Industry, Calif. USA. In a preferred embodiment, the micro-electronic gas sensor 409 is the model TGS 203 as manufactured by Figaro USA Inc. of Glenview, Ill. USA, but any gas sensor known to those skilled in the art that is able to monitor for the presence of and quantify a combustion gas may be employed. The combustion gas may be selected from the group consisting of CO, $CO_2$, HCN, HCl, $SO_x$, $NO_x$, and combinations thereof. In a preferred embodiment, the selected combustion gas is CO.

The gas sensor 409 monitors for the presence of the selected combustion gas and quantifies the level of the selected gas. In the present embodiment, the gas sensor 409 quantifies the concentration of the selected gas. The gas sensor 409 measures a change in electrical resistance, that is proportional to the concentration of the gas being detected, to generate a voltage signal. In an alternate embodiment, the gas sensor 409 measures optical absorption or transmission at one or more optical wavelengths to generate a voltage signal that is proportional to the concentration of the gas being detected. In a preferred embodiment, the gas sensor 409 measures the change in electrical resistance to generate a voltage signal proportional to the concentration of the gas being detected.

The gas sensor 409 generates a signal that corresponds to the quantified level of the selected gas. The generated signal may be a digital or analog indicator of the selected gas level. In a preferred embodiment, the generated signal is a gas voltage signal corresponding to the quantified gas level, which is sent to a gas comparison stage 411. The gas comparison stage 411 determines if the generated signal exceeds a threshold gas level; in the present embodiment, if the received gas voltage signal exceeds a threshold gas level. In a preferred embodiment, the gas comparison stage 411 is an analog comparator of the type known to those skilled in the art. In alternate embodiments of the present invention, the comparison stage 411 may be a digital comparator, an operation amplifier that filters or amplifies an input signal and generates an output signal from only a subset of possible inputs, or a logic device operating under a programmed control, such as a microprocessor, compact programmable logic device or a field programmable gate array. Any other means known to those skilled in the art that can receive an input signal that corresponds to the quantified level of the selected gas, compare the input signal to a reference value corresponding to a threshold gas level and generate an output signal if a threshold condition is satisfied may be employed.

If the quantified gas level exceeds the threshold gas level, the generated gas voltage signal is sent to a signal combiner 413. The signal combiner 413 is configured to receive and combine signals generated by the combustion gas monitor 401 (i.e., gas sensor 409) and the air borne particulate matter monitor 403 and to determine if an alarm condition has been satisfied. In a preferred embodiment of the present invention, the gas signal is sent to an AND logic gate 415 of the combiner 413.

The air borne particulate matter monitor 403 monitors for the presence of air borne particulate matter. In a preferred embodiment, the air borne particulate matter is smoke particles.

The air borne particulate matter monitor 403 may be a photo-electric particle detector 417, as is known to those skilled in the art, that incorporates an emitter model IRLED-E23 or IRLED-E24 manufactured by Gilway Technical Lamp and a detector model PDB-C134 (F) manufactured by Photonic Detectors Inc. of Simi Valley, California, USA. In a preferred embodiment the photoelectric detector 417 incorporates an emitter model PDI-E808 and a detector model PDB-C134 (F) both manufactured by Photonic Detectors Inc. of Simi Valley, Calif., USA, but any air borne particulate matter monitor known to those skilled in the art that is able to monitor for the presence of and quantify the level of air borne particulate matter may be employed.

The photoelectric particle detector 417 monitors for the presence of the selected air borne particulate matter and quantifies the level of the selected matter. In a preferred embodiment, the photo-electric particle detector 417 quantifies the concentration and density of the smoke particles.

The particle detector 417 generates a signal that corresponds to the measured level of the selected air borne particulate matter. The generated signal may be a digital or analog indicator of the air borne particulate matter level. In a preferred embodiment, the generated signal is a particle voltage signal corresponding to the air borne particulate matter level, which is sent to a particle comparison stage 419. The particle comparison stage 419 includes a "low" particle comparison stage 421 and a "high" particle comparison stage 423, each of which receive the particle voltage signal. The "low" particle comparison stage 421 determines if the received particle voltage signal exceeds a "low" particle threshold level and the "high" particle comparison stage 423 determines if the particle voltage signal exceeds a "high" particle threshold level. In a preferred embodiment, the particle comparison stage 419 is an analog comparator of the type known to those skilled in the art. In alternate embodiments of the present invention, the particle comparison stage 419 may be a digital comparator, an operation amplifier that filters or amplifies an input signal and generates an output signal from only a subset of possible inputs, or a logic device operating under a programmed control, such as a microprocessor, compact programmable logic device or a field programmable gate array. Any other means known to those skilled in the art that can receive an input signal that corresponds to the quantified level of the selected particle, compare the input signal to a reference value corresponding to a threshold particle level and generate an output signal if a threshold condition is satisfied may be employed.

If the quantified air borne particulate matter level exceeds the "low" particle threshold, the generated "low" particle voltage signal is sent to the combiner 413. In a preferred embodiment of the present invention, the "low" particle voltage signal is sent to the AND logic gate 415 of the combiner 413. If the quantified air borne particulate matter level exceeds the "high" particle threshold level, the generated "high" particle voltage signal is sent to the combiner 413. In a preferred embodiment of the present invention, the "high" particle voltage signal is sent to a OR logic gate 425 of the combiner 413.

The signal combiner 413 is configured to communicate with and receive signals from the gas comparison stage 411 and the particle comparison stage 419, respectively. The AND logic gate 415 is configured to receive signals from the gas comparison stage 411 when the gas comparison stage 411 determines that the gas threshold level has been exceeded. The AND logic gate 415 is also configured to receive signals from the "low" particle comparison stage 421 when the "low" particle comparison stage 221 determines that the "low" particle threshold level has been exceeded.

The OR logic gate 425 is in communication with the AND logic gate 415 and is also in communication with and configured to receive signals from the "high" particle comparison stage 423 when the "high" particle comparison stage 423 determines that the "high" particle threshold level has been exceeded.

The OR logic gate 425 is further in communication with the alarm 407, which is triggered when an alarm condition is satisfied, the alarm condition being satisfied when at least one of the following occurs:

(a) the quantified presence of the combustion gas exceeds the combustion gas threshold level and the quantified presence of the air borne particles exceeds the "low" particle threshold level (i.e., a first threshold air borne particulate matter level); and, (b) the quantified presence of the air borne particles exceeds the "high" particle threshold level (i.e., a second threshold air borne particulate matter level).

In the event that the first alarm condition (a) is satisfied, an alarm signal is sent from the AND logic gate 415, through the OR logic gate 425, to the alarm 407, at which point an alarm signal is generated indicating the presence of a fire. In a preferred embodiment of the present invention, the AND logic gate 415 communicates a voltage signal to the alarm 207.

In the event that the second alarm condition (b) is satisfied, an alarm signal is sent from the OR logic gate 425 to the alarm 407, at which point an alarm signal is generated indicating the presence of a fire. In a preferred embodiment of the present invention, the OR logic gate 425 communicates a voltage signal to the alarm 407.

Figure 4:
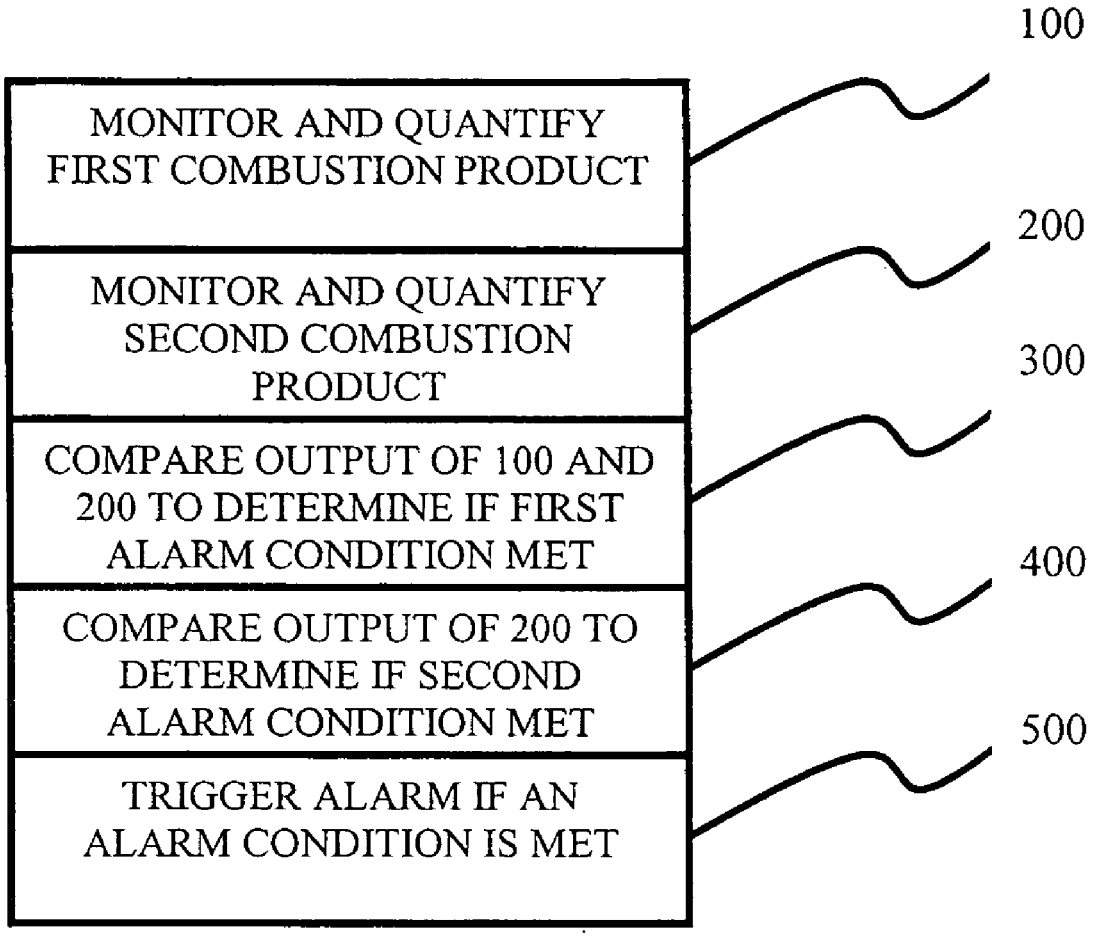
FIG. 4 is a flow chart illustrating a method for detecting and indicating the presence of combustion products according to an embodiment of the present invention.

Referring to FIG. 4, a flow chart diagram illustrates a method for detecting and indicating the presence of combustion products according to an embodiment of the present invention. The method begins at step 100, where the presence of a first combustion product is monitored for and quantified. The first combustion product may be a combustion gas, such as CO, $CO_2$; HCN, HCl, $SO_x$, $NO_x$, and combinations thereof. In a preferred embodiment of the present invention, the combustion gas is CO. The combustion gas may be monitored for and quantified by any gas sensor known to those skilled in the art, such as the F-2 CO sensor, as manufactured by Teledyne Analytical Instruments of City of Industry, Calif. USA. In a preferred embodiment, the micro-electronic gas sensor is the model TGS 203 as manufactured by Figaro USA Inc. of Glenview, Ill. USA, but any gas sensor known to those skilled in the art that is able to monitor for the presence of and quantify a combustion gas may be employed.

At step 200, the presence of a second combustion product is monitored for and quantified. In a preferred embodiment, the second indicator of combustion is air borne particulate matter, such as smoke particles. The smoke particles may be monitored for and quantified by any smoke particle detector known to those skilled in the art, that incorporates an emitter model IRLED-E23 or IRLED-E24 manufactured by Gilway Technical Lamp and a detector model PDB-C134 (F) manufactured by Photonic Detectors Inc. of Simi Valley, Calif., USA. In a preferred embodiment the smoke detector incorporates an emitter model PDI-E808 and a detector model PDB-C134 (F) both manufactured by Photonic Detectors Inc. of Simi Valley, Calif., USA.

At step 300, the outputs of steps 100 and 200 are compared to a first alarm triggering condition to determine if the first alarm condition has been satisfied. The first alarm condition is satisfied when the quantified presence of the first combustion product exceeds a first-product threshold level and the quantified presence of the second combustion product exceeds a first second-product threshold.

At step 400, the output of step 200 is compared to a second alarm triggering condition to determine if the second alarm triggering condition has been satisfied. The second alarm condition has been satisfied when the quantified presence of the second combustion product exceeds a second second-product threshold.

At step 500, an alarm is triggered when at least one alarm condition is satisfied.

Figure 5:
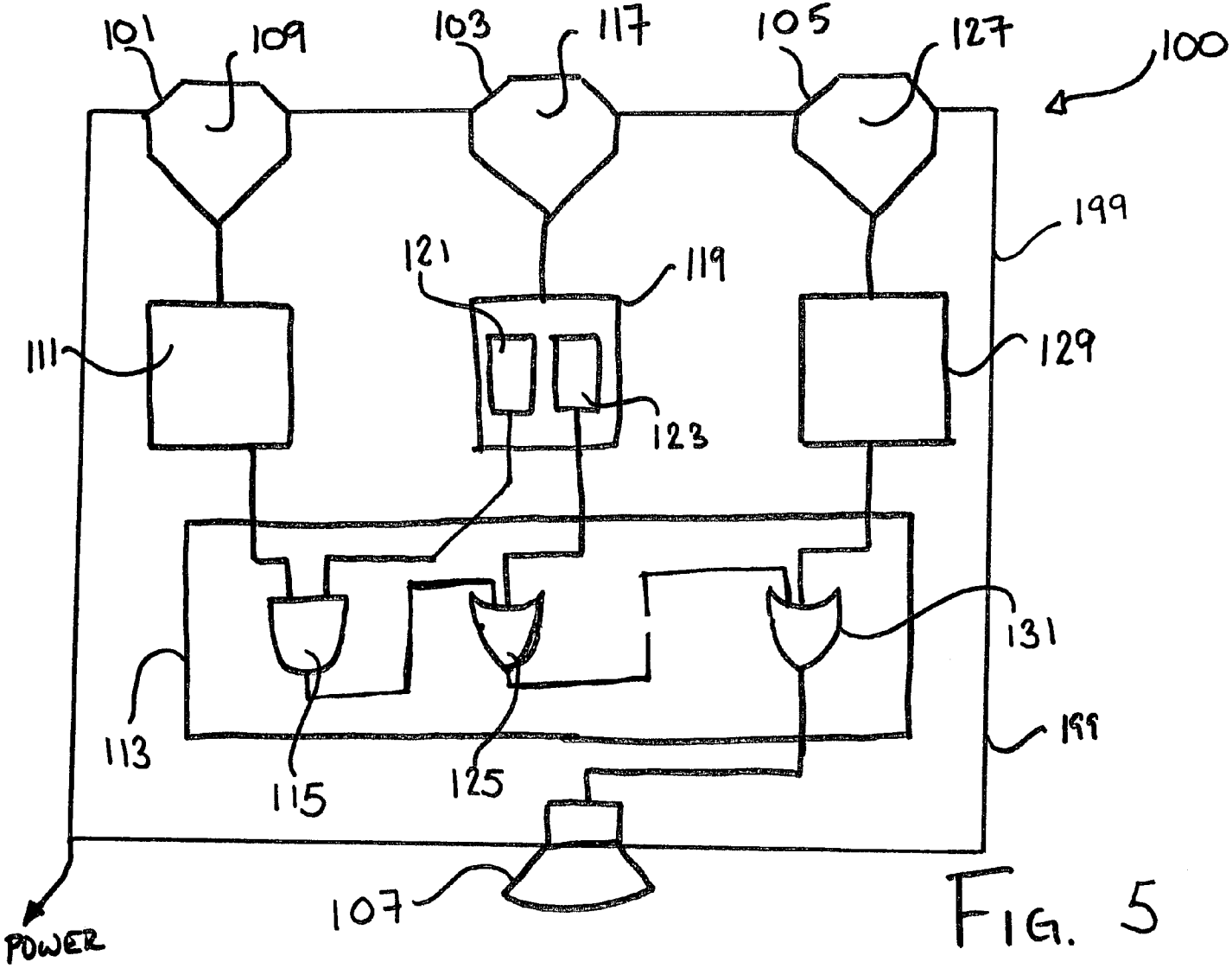
FIG. 5 is a schematic drawing illustrating an apparatus for detecting and indicating the presence of combustion products according to an alternate embodiment of the present invention.

Referring to FIG. 5, an apparatus 100 for detecting and indicating the presence of combustion products according an alternate embodiment of the present invention is illustrated. The apparatus 100 is comprised of a combustion gas monitor 101 for monitoring for the presence of a combustion gas and quantifying the combustion gas; an air borne particulate matter monitor 103 for monitoring for the presence of an air borne particulate matter and quantifying the air borne particulate matter; a temperature monitor 105 for measuring an ambient temperature and quantifying a change in the ambient temperature; and, an alarm 107 connected to and in communication with the combustion gas monitor 101, air borne particulate matter monitor 103 and temperature monitor 105 for triggering an alarm response when an alarm condition is satisfied.

The combustion gas monitor 101 may be a micro-electronic gas sensor 109, as is known to those skilled in the art, such as the F-2 CO sensor, as manufactured by Teledyne Analytical Instruments of City of Industry, Calif. USA. In a preferred embodiment, the micro-electronic gas sensor 109 is the model TGS 203 as manufactured by Figaro USA Inc. of Glenview, Ill. USA, but any gas sensor known to those skilled in the art that is able to monitor for the presence of and quantify a combustion gas may be employed. The combustion gas may be selected from the group consisting of CO, $CO_2$, HCN, HCl, $SO_x$, $NO_x$, and combinations thereof. In a preferred embodiment, the selected combustion gas is CO.

The gas sensor 109 monitors for the presence of the selected combustion gas and quantifies the level of the selected gas. In the present embodiment, the gas sensor 109 quantifies the concentration of the selected gas. The gas sensor 109 measures a change in electrical resistance, that is proportional to the concentration of the gas being detected, to generate a voltage signal. In an alternate embodiment, the gas sensor 109 measures optical absorption or transmission at one or more optical wavelengths to generate a voltage signal that is proportional to the concentration of the gas being detected. In a preferred embodiment, the gas sensor 109 measures the change in electrical resistance to generate a voltage signal proportional to the concentration of the gas being detected.

The gas sensor 109 generates a signal that corresponds to the quantified level of the selected gas. The generated signal may be a digital or analog indicator of the selected gas level. In a preferred embodiment, the generated signal is a gas voltage signal corresponding to the quantified gas level, which is sent to a gas comparison stage 111. The gas comparison stage 111 determines if the generated signal exceeds a threshold gas level; in the present embodiment, if the received gas voltage signal exceeds a threshold gas level. In a preferred embodiment, the gas comparison stage 111 is an analog comparator of the type known to those skilled in the art. In alternate embodiments of the present invention, the comparison stage 111 may be a digital comparator, an operation amplifier that filters or amplifies an input signal and generates an output signal from only a subset of possible inputs, or a logic device operating under a programmed control, such as a microprocessor, compact programmable logic device or a field programmable gate array. Any other means known to those skilled in the art that can receive an input signal that corresponds to the quantified level of the selected gas, compare the input signal to a reference value corresponding to a threshold gas level and generate an output signal if a threshold condition is satisfied may be employed.

If the quantified gas level exceeds the threshold gas level, the generated gas voltage signal is sent to a signal combiner 113. The signal combiner 113 is configured to receive and combine signals generated by the combustion gas monitor 101, air borne particulate matter monitor 103 and temperature monitor 105 and to determine if an alarm condition has been satisfied. In a preferred embodiment of the present invention, the gas signal is sent to an AND logic gate 115 of the combiner 113.

The air borne particulate matter monitor 103 monitors for the presence of air borne particulate matter. In a preferred embodiment, the air borne particulate matter is smoke particles.

The air borne particulate matter monitor 103 may be a photo-electric particle detector 117, as is known to those skilled in the art, that incorporates an emitter model IRLED-E23 or IRLED-E24 manufactured by Gilway Technical Lamp and a detector model PDB-C134 (F) manufactured by Photonic Detectors Inc. of Simi Valley, Calif., USA. In a preferred embodiment the photoelectric detector 117 incorporates an emitter model PDI-E808 and a detector model PDB-C134 (F) both manufactured by Photonic Detectors Inc. of Simi Valley, Calif., USA, but any air borne particulate matter monitor known to those skilled in the art that is able to monitor for the presence of and quantify the level of air borne particulate matter may be employed.

The photoelectric particle detector 117 monitors for the presence of the selected air borne particulate matter and quantifies the level of the selected matter. In a preferred embodiment, the photo-electric particle detector 117 quantifies the concentration and density of the smoke particles.

The particle detector 117 generates a signal that corresponds to the measured level of the selected air borne particulate matter. The generated signal may be a digital or analog indicator of the air borne particulate matter level. In a preferred embodiment, the generated signal is a particle voltage signal corresponding to the air borne particulate matter level, which is sent to a particle comparison stage 119. The particle comparison stage 119 includes a "low" particle comparison stage 121 and a "high" particle comparison stage 123, each of which receive the particle voltage signal. The "low" particle comparison stage 121 determines if the received particle voltage signal exceeds a "low" particle threshold level and the "high" particle comparison stage 123 determines if the particle voltage signal exceeds a "high" particle threshold level. In a preferred embodiment, the particle comparison stage 119 is an analog comparator of the type known to those skilled in the art. In alternate embodiments of the present invention, the particle comparison stage 119 may be a digital comparator, an operation amplifier that filters or amplifies an input signal and generates an output signal from only a subset of possible inputs, or a logic device operating under a programmed control, such as a microprocessor, compact programmable logic device or a field programmable gate array. Any other means known to those skilled in the art that can receive an input signal that corresponds to the quantified level of the selected particle, compare the input signal to a reference value corresponding to a threshold particle level and generate an output signal if a threshold condition is satisfied may be employed.

If the quantified air borne particulate matter level exceeds the "low" particle threshold, the generated "low" particle voltage signal is sent to the combiner 113. In a preferred embodiment of the present invention, the "low" particle voltage signal is sent to the AND logic gate 115 of the combiner 113. If the quantified air borne particulate matter level exceeds the "high" particle threshold level, the generated "high" particle voltage signal is sent to the combiner 113. In a preferred embodiment of the present invention, the "high" particle voltage signal is sent to a first OR logic gate 125 of the combiner 113.

The temperature monitor 105 measures the ambient temperature and quantifies any change in the ambient temperature. The temperature monitor 105 may be a thermistor 127, as is known to those skilled in the art, such as the model NTSAOHXH103_E1BO as manufactured by Murata Manufacturing Company Ltd of Kyoto, Japan. In a preferred embodiment of the present invention, the thermistor 127 is the model MLX 90247 LRA-C as manufactured by Melexis Microelectronic Integrated Systems of Concord, N.H. USA, but any temperature monitor known to those skilled in the art that is able to measure ambient temperature and quantify ambient temperature changes may be employed.

The temperature monitor 105 generates a signal that corresponds to the change in the ambient temperature. The generated signal may be a digital or analog indicator of the ambient temperature. In a preferred embodiment, the generated signal is a voltage temperature signal corresponding to the ambient temperature, which is sent to a temperature comparison stage 129. The temperature comparison stage 129 determines if the quantified temperature change exceeds a threshold temperature change; in the present embodiment, if the received temperature voltage signal exceeds a threshold temperature level. In a preferred embodiment, the temperature comparison stage 129 is an analog comparator of the type known to those skilled in the art. In alternate embodiments of the present invention, the temperature comparison stage 129 may be a digital comparator, an operation amplifier that filters or amplifies an input signal and generates an output signal from only a subset of possible inputs, or a logic device operating under a programmed control, such as a microprocessor, compact programmable logic device or a field programmable gate array. Any other means known to those skilled in the art that can receive an input signal that corresponds to the quantified temperature change, compare the input signal to a reference value corresponding to a threshold temperature change and generate an output signal if a threshold condition is satisfied may be employed.

If the quantified temperature exceeds the threshold temperature change, the generated voltage temperature signal is sent to the combiner 113. In a preferred embodiment of the present invention, the temperature signal is sent to a second OR logic gate 131 of the combiner 113.

Figure 6:
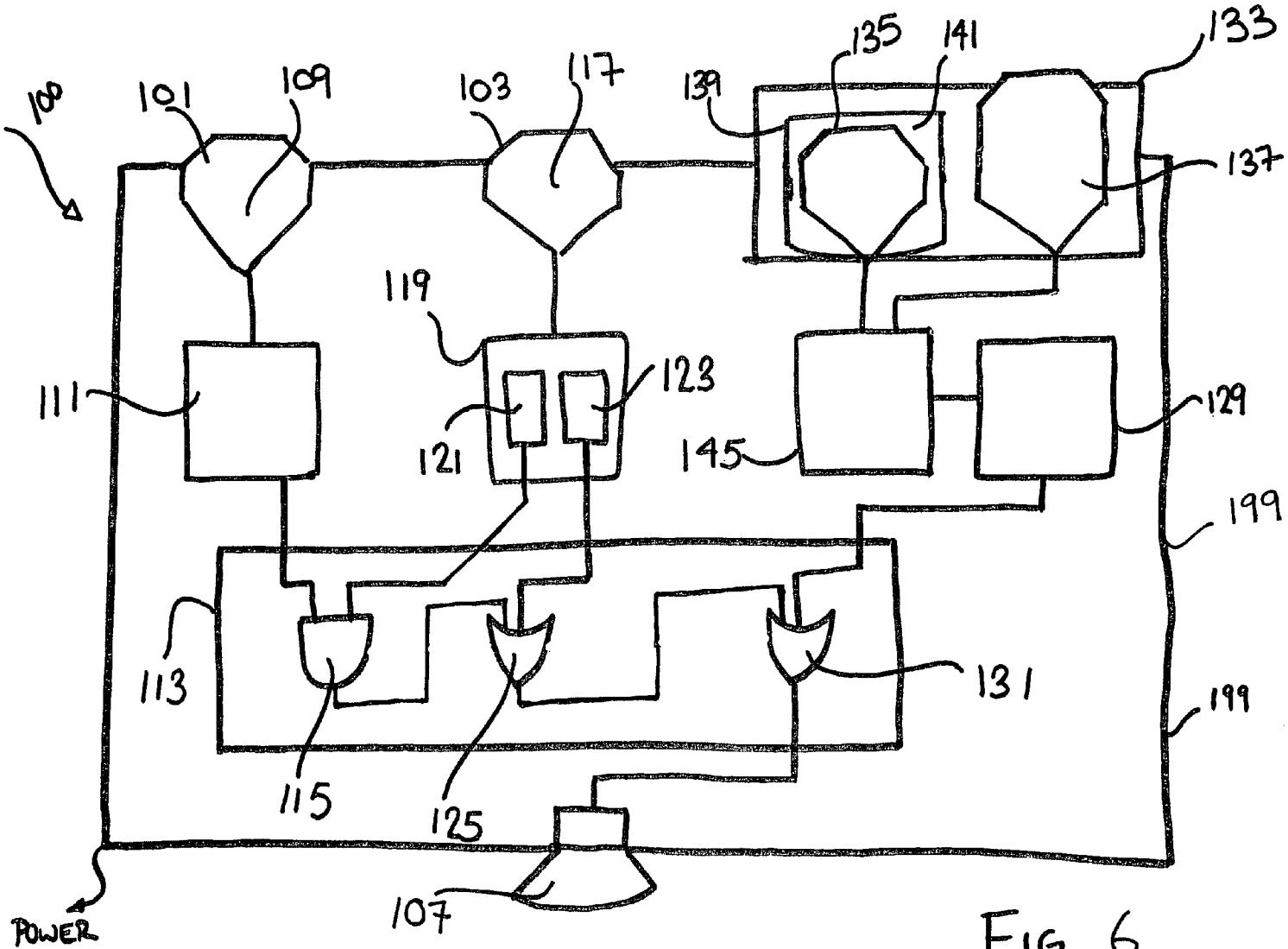
FIG. 6 is a schematic drawing illustrating the apparatus in FIG. 5 according to a further alternate embodiment of the present invention.

Referring to FIG. 6, an alternate embodiment of a temperature monitor is illustrated. The alternate temperature monitor 133 employs a first thermistor 135 and a second thermistor 137. The first thermistor 135 is enclosed in a container or shroud 139, which defines and enclosed shroud space 141 that is isolated from the atmosphere. The shroud 139 is comprised of any insulative material known to those skilled in the art that ensures that the temperature of the shroud space 141 does not vary significantly with rapid variances in the temperature of the ambient atmosphere, as may happen in the presence of a fire. Accordingly, the first thermistor 135 quantifies only the temperature of the shroud space 141. The second thermistor 137 is exposed to the ambient atmosphere. Accordingly, it is able to quantify the ambient atmosphere temperature.

The first thermistor 135 generates a signal that corresponds to the temperature of the shroud space 141. The generated signal may be a digital or analog indicator of the shroud space 141 temperature. In a preferred embodiment, the generated signal is a voltage shroud temperature signal, which is sent to a temperature difference monitor 145.

The second thermistor 137 generates a signal that corresponds to the quantified ambient temperature. The generated signal may be a digital or analog indicator of the ambient temperature. In a preferred embodiment, the generated signal is a voltage ambient temperature signal, which is sent to the temperature difference monitor 145.

The temperature difference monitor 145 compares the voltage shroud temperature. signal and the voltage ambient temperature signal to determine the temperature difference, which is then sent to a temperature comparison stage 129. The temperature comparison stage 129 determines if the temperature difference between the shroud space 141 and the ambient atmosphere exceeds a threshold temperature difference; in the present embodiment, if the received temperature voltage signal exceeds a threshold temperature level. In a preferred embodiment, the temperature comparison stage 129 is an analog comparator of the type known to those skilled in the art. In alternate embodiments of the present invention, the temperature comparison stage 129 may be a digital comparator, an operation amplifier that filters or amplifies an input signal and generates an output signal from only a subset of possible inputs, or a logic device operating under a programmed control, such as a microprocessor, compact programmable logic device or a field programmable gate array. Any other means known to those skilled in the art that can receive an input signal that corresponds to the quantified temperature difference, compare the input signal to a reference value corresponding to a threshold temperature difference and generate an output signal if a threshold condition is satisfied may be employed.

If the temperature difference exceeds a threshold temperature difference, the temperature difference signal is sent to the combiner 113. In a preferred embodiment of the present invention, the difference signal is sent to the second OR logic gate 131 of the combiner 113.

Referring to FIGS. 5 and 6, the signal combiner 113 is configured to receive signals from the gas comparison stage 111, particle comparison stage 119 and the temperature comparison stage 129, respectively. The AND logic gate 115 is configured to receive signals from the gas comparison stage 111 when the gas comparisons stage 111 determines that the gas threshold level has been exceeded. The AND logic gate 115 is also configured to receive signals from the "low" particle comparison stage 121 when the "low" particle comparison stage 121 determines that the "low" particle threshold level has been exceeded.

The first OR logic gate 125 is connected to the AND logic gate 115 and is also connected to and configured to receive signals from the "high" particle comparison stage 123 when the "high" particle comparison stage 123 determines that the "high" particle threshold level has been exceeded.

The second OR logic gate 131 is connected to the first OR logic gate 125 and is also connected to and configured to receive signals from the temperature comparison stage 129 when the temperature comparison stage 129 determines that the temperature threshold level has been exceeded. In an alternate embodiment of the present invention, the second OR logic gate 131 is configured to receive signals from the temperature comparison stage 129 when the temperature comparison stage 129 determines that the temperature difference threshold between the first thermistor 135 and the second thermistor 137 has been exceeded. The second OR logic gate 131 is further connected to the alarm 107, which is triggered when an alarm condition is satisfied, the alarm condition being satisfied when at least one of the following occurs:

(a) the quantified presence of the combustion gas exceeds the combustion gas threshold level and the quantified presence of the air borne particles exceeds the "low" particle threshold level (i.e., a first threshold air borne particulate matter level);

(b) the quantified presence of the air borne particles exceeds the "high" particle threshold level (i.e., a second threshold air borne particulate matter level); and, (c) the quantified change in the ambient temperature exceeds a threshold temperature change level.

In the event that the first alarm condition (a) is satisfied, an alarm signal is sent from the AND logic gate 115, through the first and second OR logic gates (125, 131), to the alarm 107, at which point an alarm signal is generated indicating the presence of a fire. In a preferred embodiment of the present invention, the AND logic gate 115 communicates a voltage signal to the alarm 107.

In the event that the second alarm condition (b) is satisfied, an alarm signal is sent from the first OR logic gate 125, through the second OR logic gate 131, to the alarm 107, at which point an alarm signal is generated indicating the presence of a fire. In a preferred embodiment of the present invention, the first OR logic gate 125 communicates a voltage signal to the alarm 107.

In the event that the third alarm condition (c) is satisfied, an alarm signal is sent from the second OR logic gate 131 to the alarm 107, at which point an alarm signal is generated indicating the presence of a fire. In a preferred embodiment of the present invention, the second OR logic gate 131 communicates a voltage signal to the alarm 107.

In a preferred embodiment, the first combustion gas monitor 101, airborne particulate matter monitor 103, temperature monitor 15, alarm 107, comparison stage 111 and combiner 113 are mounted in a housing 199. The housing 199 includes access points, which provide the monitors 101, 103 and 105 with access to the outside environment in order to monitor for the presence of their respective combustion products.

Figure 7:
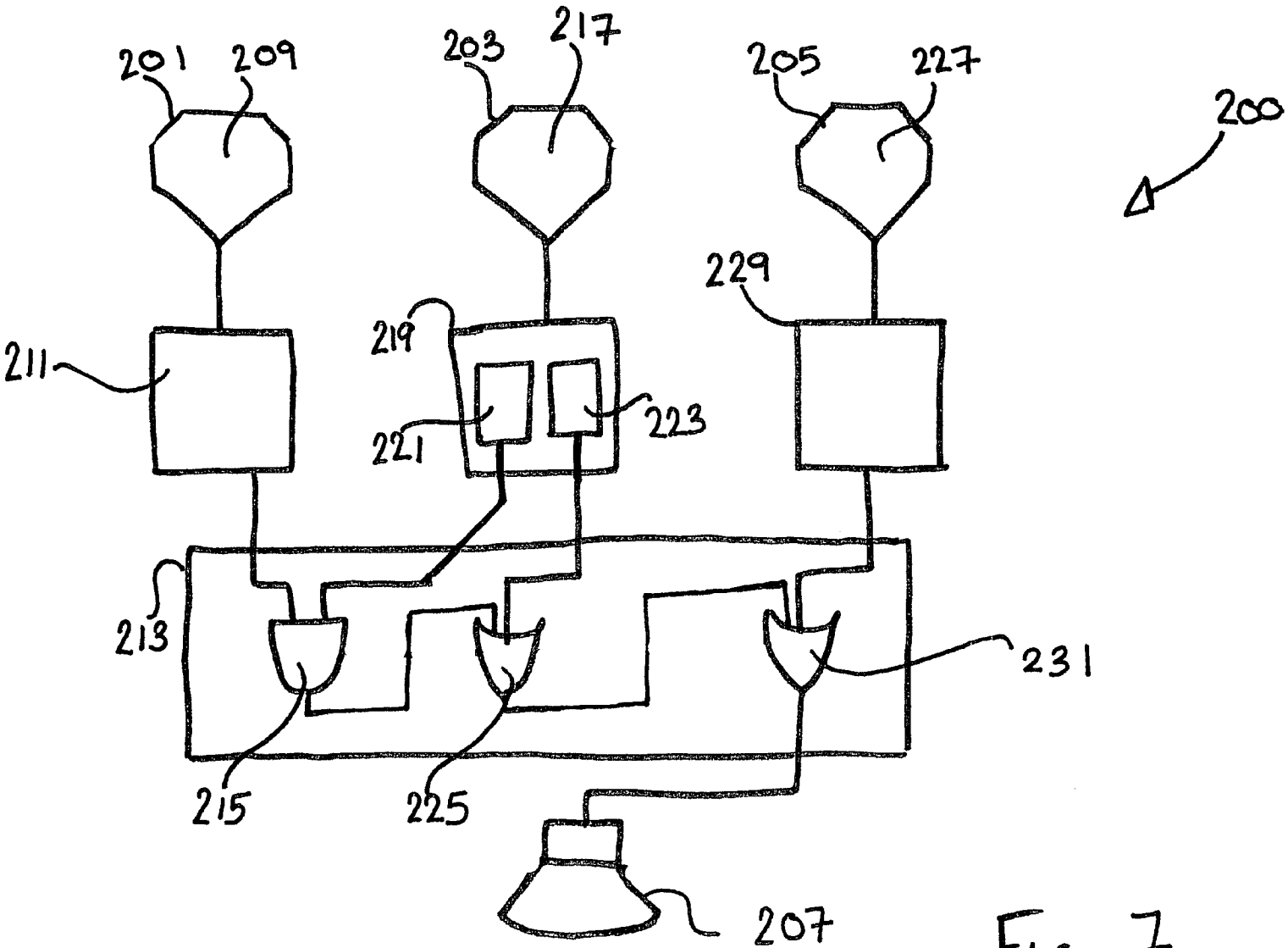
FIG. 7 is a schematic drawing illustrating a system for detecting and indicating the presence of combustion products according to an alternate embodiment of the present invention.

Referring to FIG. 7, a system 200 for detecting and indicating the presence of combustion products according an embodiment of the present invention is illustrated. The system 200 is comprised of a combustion gas monitor 201 for monitoring for the presence of a combustion gas and quantifying the combustion gas; an air borne particulate matter monitor 203 for monitoring for the presence of an air borne particulate matter and quantifying the air borne particulate matter; a temperature monitor 205 for measuring an ambient temperature and quantifying a change in the ambient temperature; and, an alarm 207 in communication with the combustion gas monitor 201, air borne particulate matter monitor 203 and temperature monitor 205 for triggering an alarm response when an alarm condition is satisfied.

The combustion gas monitor 201 may be a micro-electronic gas sensor 209, as is known to those skilled in the artsuch as the F-2 CO sensor, as manufactured by Teledyne Analytical Instruments of City of Industry, California USA. In a preferred embodiment, the micro-electronic gas sensor 209 is the model TGS 203 as manufactured by Figaro USA Inc. of Glenview, Ill. USA, but any gas sensor known to those skilled in the art that is able to monitor for the presence of and quantify a combustion gas may be employed. The combustion gas may be selected from the group consisting of CO, $CO_2$, HCN, HCl, $SO_x$, $NO_x$, and combinations thereof. In a preferred embodiment, the selected combustion gas is CO.

The gas sensor 209 monitors for the presence of the selected combustion gas and quantifies the level of the selected gas. In the present embodiment, the gas sensor 209 quantifies the concentration of the selected gas. The gas sensor 209 measures a change in electrical resistance, that is proportional to the concentration of the gas being detected, to generate a voltage signal. In an alternate embodiment, the gas sensor 209 measures optical absorption or transmission at one or more optical wavelengths to generate a voltage signal that is proportional to the concentration of the gas being detected. In a preferred embodiment, the gas sensor 209 measures the change in electrical resistance to generate a voltage signal proportional to the concentration of the gas being detected.

The gas sensor 209 generates a signal that corresponds to the quantified level of the selected gas. The generated signal may be a digital or analog indicator of the selected gas level. In a preferred embodiment, the generated signal is a gas voltage signal corresponding to the quantified gas level, which is sent to a gas comparison stage 211. The gas comparison stage 211 determines if the generated signal exceeds a threshold gas level; in the present embodiment, if the received gas voltage signal exceeds a threshold gas level. In a preferred embodiment, the gas comparison stage 211 is an analog comparator of the type known to those skilled in the art. In alternate embodiments of the present invention, the comparison stage 211 may be a digital comparator, an operation amplifier that filters or amplifies an input signal and generates an output signal from only a subset of possible inputs, or a logic device operating under a programmed control, such as a microprocessor, compact programmable logic device or a field programmable gate array. Any other means known to those skilled in the art that can receive an input signal that corresponds to the quantified level of the selected gas, compare the input signal to a reference value corresponding to a threshold gas level and generate an output signal if a threshold condition is satisfied may be employed.

If the quantified gas level exceeds the threshold gas level, the generated gas voltage signal is sent to a signal combiner 213. The signal combiner 213 is configured to receive and combine signals generated by the combustion gas monitor 201, air borne particulate matter monitor 203 and temperature monitor 205 and to determine if an alarm condition has been satisfied. In a preferred embodiment of the present invention, the gas signal is sent to an AND logic gate 215 of the combiner 213.

The air borne particulate matter monitor 203 monitors for the presence of air borne particulate matter. In a preferred embodiment, the air borne particulate matter is smoke particles.

The air borne particulate matter monitor 203 may be a photo-electric particle detector 217, as is known to those skilled in the art, as is known to those skilled in the art, that incorporates an emitter model IRLED-E23 or IRLED-E24 manufactured by Gilway Technical Lamp and a detector model PDB-C134 (F) manufactured by Photonic Detectors Inc. of Simi Valley, Calif., USA. In a preferred embodiment the photoelectric detector 217 incorporates an emitter model PDI-E808 and a detector model PDB-C134 (F) both manufactured by Photonic Detectors Inc. of Simi Valley, Calif., USA, but any air borne particulate matter monitor known to those skilled in the art that is able to monitor for the presence of and quantify the level of air borne particulate matter may be employed.

The photoelectric particle detector 217 monitors for the presence of the selected air borne particulate matter and quantifies the level of the selected matter. In a preferred embodiment, the photo-electric particle detector 217 quantifies the concentration and density of the smoke particles.

The particle detector 217 generates a signal that corresponds to the measured level of the selected air borne particulate matter. The generated signal may be a digital or analog indicator of the air borne particulate matter level. In a preferred embodiment, the generated signal is a particle voltage signal corresponding to the air borne particulate matter level, which is sent to a particle comparison stage 219. The particle comparison stage 219 includes a "low" particle comparison stage 221 and a "high" particle comparison stage 223, each of which receive the particle voltage signal. The "low" particle comparison stage 221 determines if the received particle voltage signal exceeds a "low" particle threshold level and the "high" particle comparison stage 223 determines if the particle voltage signal exceeds a "high" particle threshold level. In a preferred embodiment, the particle comparison stage 219 is an analog comparator of the type known to those skilled in the art. In alternate embodiments of the present invention, the particle comparison stage 219 may be a digital comparator, an operation amplifier that filters or amplifies an input signal and generates an output signal from only a subset of possible inputs, or a logic device operating under a programmed control, such as a microprocessor, compact programmable logic device or a field programmable gate array. Any other means known to those skilled in the art that can receive an input signal that corresponds to the quantified level of the selected particle, compare the input signal to a reference value corresponding to a threshold particle level and generate an output signal if a threshold condition is satisfied may be employed.

If the quantified air borne particulate matter level exceeds the "low" particle threshold, the generated "low" particle voltage signal is sent to the combiner 213. In a preferred embodiment of the present invention, the "low" particle voltage signal is sent to the AND logic gate 215 of the combiner 213. If the quantified air borne particulate matter level exceeds the "high" particle threshold level, the generated "high" particle voltage signal is sent to the combiner 213. In a preferred embodiment of the present invention, the "high" particle voltage signal is sent to a first OR logic gate 225 of the combiner 213.

The temperature monitor 205 measures the ambient temperature and quantifies any change in the ambient temperature. The temperature monitor 205 may be a thermistor 227, as is known to those skilled in the art, such as the model NTSAOHXH103_E1BO as manufactured by Murata Manufacturing Company Ltd of Kyoto, Japan. In a preferred embodiment of the present invention, the thermistor 227 is the model MLX 90247 LRA-C as manufactured by Melexis Microelectronic Integrated Systems of Concord, N.H. USA, but any temperature monitor known to those skilled in the art that is able to measure ambient temperature and quantify ambient temperature changes may be employed.

The temperature monitor 205 generates a signal that corresponds to the change in the ambient temperature. The generated signal may be a digital or analog indicator of the ambient temperature. In a preferred embodiment, the generated signal is a voltage temperature signal corresponding to the ambient temperature, which is sent to a temperature comparison stage 229. The temperature comparison stage 229 determines if the quantified temperature change exceeds a threshold temperature change; in the present embodiment, if the received temperature voltage signal exceeds a threshold temperature level. In a preferred embodiment, the temperature comparison stage 229 is an analog comparator of the type known to those skilled in the art. In alternate embodiments of the present invention, the temperature comparison stage 229 may be a digital comparator, an operation amplifier that filters or amplifies an input signal and generates an output signal from only a subset of possible inputs, or a logic device operating under a programmed control, such as a microprocessor, compact programmable logic device or a field programmable gate array. Any other means known to those skilled in the art that can receive an input signal that corresponds to the quantified temperature change, compare the input signal to a reference value corresponding to a threshold temperature change and generate an output signal if a threshold condition is satisfied may be employed.

If the quantified temperature exceeds the threshold temperature change, the generated voltage temperature signal is sent to the combiner 213. In a preferred embodiment of the present invention, the temperature signal is sent to a second OR logic gate 231 of the combiner 213.

Figure 8:
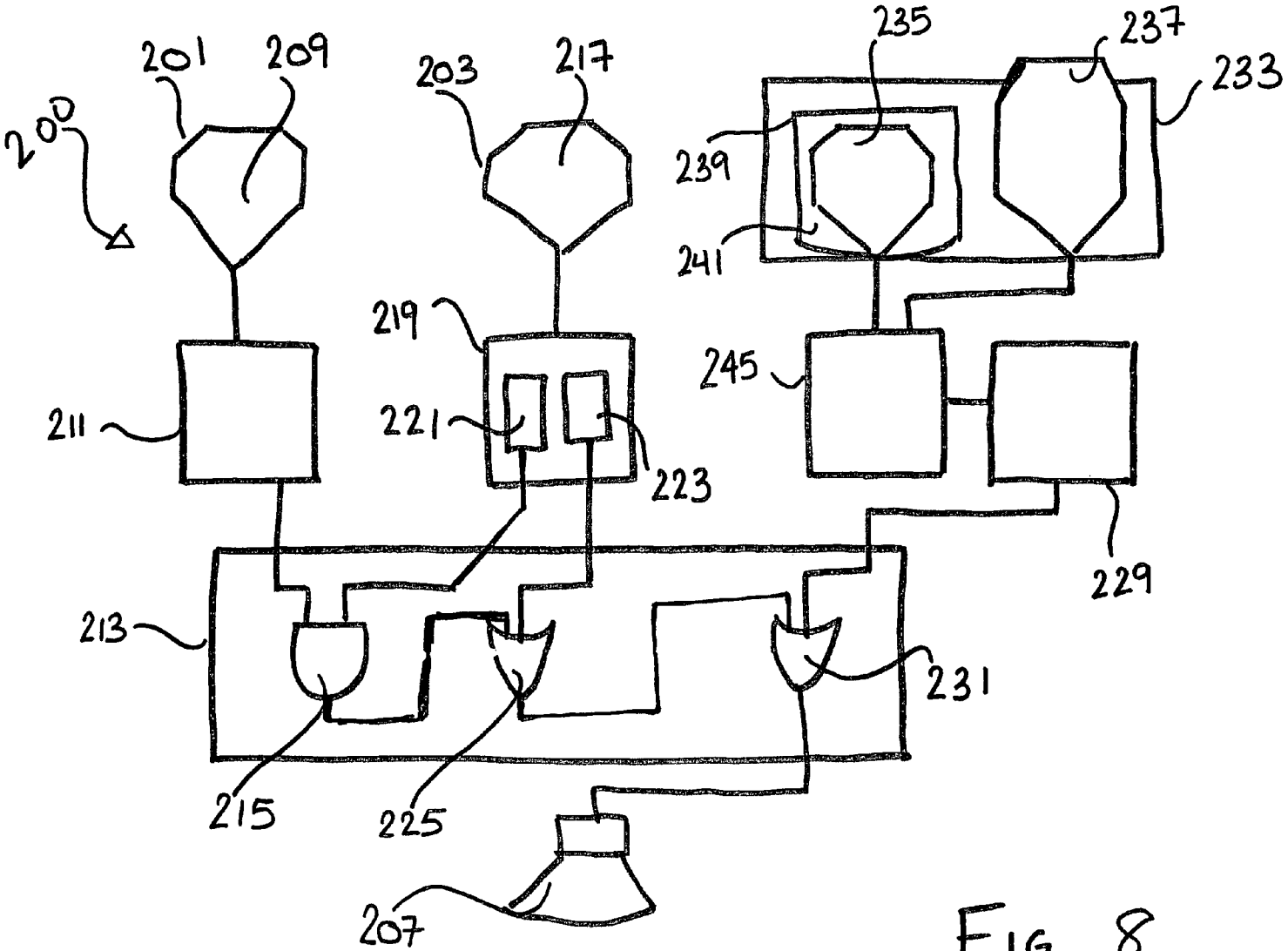
FIG. 8 is a schematic drawing illustrating the system in FIG. 7 according to a further alternate embodiment of the present invention.

Referring to FIG. 8, an alternate embodiment of a temperature monitor is illustrated. The alternate temperature monitor 233 employs a first thermistor 235 and a second thermistor 237. The first thermistor 235 is enclosed in a container or shroud 239, which defines and enclosed shroud space 241 that is insulated from the local ambient atmosphere. The shroud 239 is comprised of any insulative material known to those skilled in the art that ensures that the temperature of the shroud space 241 does not vary with variances in the temperature of the ambient atmosphere. Accordingly, the first thermistor 235 quantifies only the temperature of the shroud space 241. The second thermistor 237 is exposed to the ambient atmosphere. Accordingly, it is able to quantify the ambient atmosphere temperature.

The first thermistor 235 generates a signal that corresponds to the temperature of the shroud space 241. The generated signal may be a digital or analog indicator of the shroud space 241 temperature. In a preferred embodiment, the generated signal is a voltage shroud temperature signal, which is sent to a temperature difference monitor 245.

The second thermistor 237 generates a signal that corresponds to the quantified ambient temperature. The generated signal may be a digital or analog indicator of the ambient temperature. In a preferred embodiment, the generated signal is a voltage ambient temperature signal, which is sent to the temperature difference monitor 245.

The temperature difference monitor 245 compares the voltage shroud temperature signal and the voltage ambient temperature signal to determine the temperature difference, which is then sent to a temperature comparison stage 229. The temperature comparison stage 229 determines if the temperature difference between the shroud space 241 and the ambient atmosphere exceeds a threshold temperature difference; in the present embodiment, if the received temperature voltage signal exceeds a threshold temperature level. In a preferred embodiment, the temperature comparison stage 229 is an analog comparator of the type known to those skilled in the art. In alternate embodiments of the present invention, the temperature comparison stage 229 may be a digital comparator, an operation amplifier that filters or amplifies an input signal and generates an output signal from only a subset of possible inputs, or a logic device operating under a programmed control, such as a microprocessor, compact programmable logic device or a field programmable gate array. Any other means known to those skilled in the art that can receive an input signal that corresponds to the quantified temperature difference, compare the input signal to a reference value corresponding to a threshold temperature difference and generate an output signal if a threshold condition is satisfied may be employed.

If the temperature difference exceeds a threshold temperature difference, the temperature difference signal is sent to the combiner 213. In a preferred embodiment of the present invention, the difference signal is sent to the second OR logic gate 231 of the combiner 213.

Referring to FIGS. 7 and 8, the signal combiner 213 is configured to communicate with and receive signals from the gas comparison stage 211, particle comparison stage 219 and the temperature comparison stage 229, respectively. The AND logic gate 215 is configured to receive signals from the gas comparison stage 211 when the gas comparison stage 211 determines that the gas threshold level has been exceeded. The AND logic gate 215 is also configured to receive signals from the "low" particle comparison stage 221 when the "low" particle comparison stage 221 determines that the "low" particle threshold level has been exceeded.

The first OR logic gate 225 is in communication with the AND logic gate 215 and is also in communication with and configured to receive signals from the "high" particle comparison stage 223 when the "high" particle comparison stage 223 determines that the "high" particle threshold level has been exceeded.

The second OR logic gate 231 is in communication with the first OR logic gate 225 and is also in communication with and configured to receive signals from the temperature comparison stage 229 when the temperature comparison stage 229 determines that the temperature threshold level has been exceeded. In an alternate embodiment of the present invention, the second OR logic gate 231 is configured to receive signals from the temperature comparison stage 229 when the temperature comparison stage 229 determines that the temperature difference threshold between the first thermistor 235 and the second thermistor 237 has been exceeded. The second OR logic gate 231 is further in communication with the alarm 207, which is triggered when an alarm condition is satisfied, the alarm condition being satisfied when at least one of the following occurs:

(a) the quantified presence of the combustion gas exceeds the combustion gas threshold level and the quantified presence of the air borne particles exceeds the "low" particle threshold level (i.e., a first threshold air borne particulate matter level);

(b) the quantified presence of the air borne particles exceeds the "high" particle threshold level (i.e., a second threshold air borne particulate matter level); and, (c) the quantified change in the ambient temperature exceeds a threshold temperature change level.

In the event that the first alarm condition (a) is satisfied, an alarm signal is sent from the AND logic gate 215, through the first and second OR logic gates (225, 231), to the alarm 207, at which point an alarm signal is generated indicating the presence of a fire. In a preferred embodiment of the present invention, the AND logic gate 215 communicates a voltage signal to the alarm 207.

In the event that the second alarm condition (b) is satisfied, an alarm signal is sent from the first OR logic gate 225, through the second OR logic gate 231, to the alarm 207, at which point an alarm signal is generated indicating the presence of a fire. In a preferred embodiment of the present invention, the first OR logic gate 225 communicates a voltage signal to the alarm 207.

In the event that the third alarm condition (c) is satisfied, an alarm signal is sent from the second OR logic gate 231 to the alarm 207, at which point an alarm signal is generated indicating the presence of a fire. In a preferred embodiment of the present invention, the second OR logic gate 231 communicates a voltage signal to the alarm 207.

Figure 9:
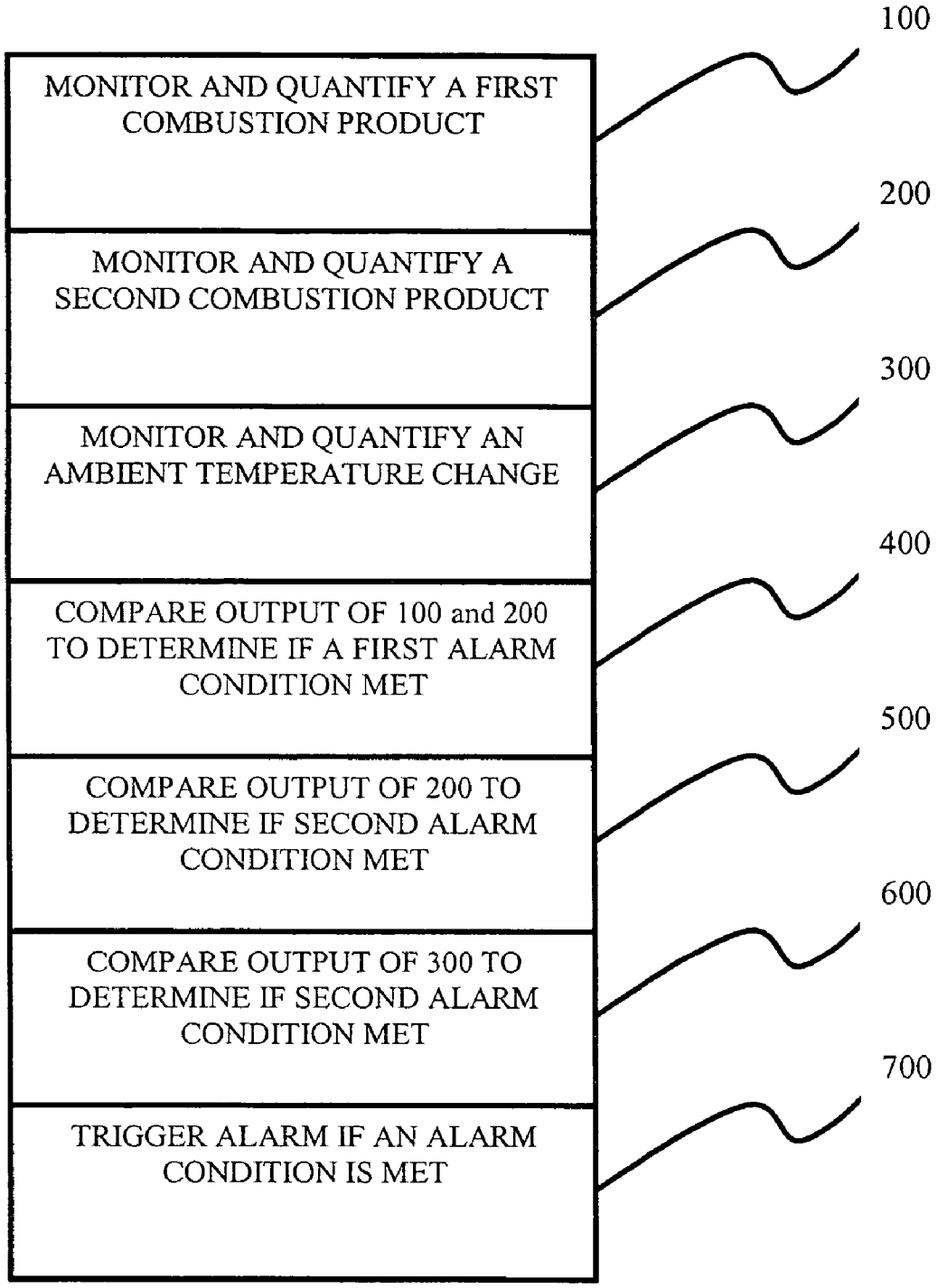
FIG. 9 is a schematic drawing illustrating a method of detecting and indicating the presence of combustion products according to an alternate embodiment of the present invention.

Referring to FIG. 9, a flow chart diagram illustrates a method for detecting and indicating the presence of combustion products according to an embodiment of the present invention. The method begins at step 100, where the presence of a first combustion product is monitored for and quantified. The first combustion product may be a combustion gas, such as CO, $CO_2$, HCN, HCl, $SO_x$, $NO_x$, and combinations thereof. In a preferred embodiment of the present invention, the combustion gas is CO. The combustion gas may be monitored for and quantified by any gas sensor known to those skilled in the art, such as the F-2 CO sensor, as manufactured by Teledyne Analytical Instruments of City of Industry, Calif. USA. In a preferred embodiment, the micro-electronic gas sensor is the model TGS 203 as manufactured by Figaro USA Inc. of Glenview, Ill. USA, but any gas sensor known to those skilled in the art that is able to monitor for the presence of and quantify a combustion gas may be employed.

At step 200, the presence of a second combustion product is monitored for and quantified. In a preferred embodiment, the second indicator of combustion is air borne particulate matter, such as smoke particles. The smoke particles may be monitored for and quantified by any smoke particle detector known to those skilled in the art, that incorporates an emitter model IRLED-E23 or IRLED-E24 manufactured by Gilway Technical Lamp and a detector model PDB-C134 (F) manufactured by Photonic Detectors Inc. of Simi Valley, Calif., USA. In a preferred embodiment the smoke detector incorporates an emitter model PDI-E808 and a detector model PDB-C134 (F) both manufactured by Photonic Detectors Inc. of Simi Valley, Calif., USA.

At step 300, the ambient temperature is measured and any change in the ambient temperature is quantified. A temperature monitor is used for measuring an ambient temperature and quantifying a change in the ambient temperature. In a preferred embodiment, the temperature monitor may be any thermistor known to those skilled in the art, such as the model MLX 90247 LRA-C as manufactured by Melexis Microelectronic Integrated Systems of Concord, N.H. USA, but any temperature monitor known to those skilled in the art that is able to measure ambient temperature and quantify ambient temperature changes may be employed.

In a preferred embodiment, the thermistor measures the temperature directly. In an alternate embodiment, two thermistors are employed to measure a change in the ambient temperature. A first thermistor contained within a shroud of insulative material measures a first temperature corresponding to the temperature within the space defined by the shroud. A second thermistor, which is exposed to the ambient atmosphere, measures a second temperature corresponding to the temperature of the ambient atmosphere. The first temperature and second temperature are then compared to determine a temperature difference.

At step 400, the outputs of steps 100 and 200 are compared to a first alarm triggering condition to determine if the first alarm condition has been satisfied. The first alarm condition is satisfied when the quantified presence of the first combustion product exceeds a first-product threshold level and the quantified presence of the second combustion product exceeds a first second-product threshold.

At step 500, the output of step 200 is compared to a second alarm triggering condition to determine if the second alarm triggering condition has been satisfied. The second alarm condition has been satisfied when the quantified presence of the second combustion product exceeds a second second-product threshold.

At step 600, the output of step 300 is compared to a third alarm triggering condition to determine if the third alarm triggering condition has been satisfied. The third alarm condition has been satisfied when the quantified change in the ambient temperature exceeds a threshold temperature change level.

At step 700, an alarm is triggered when at least one alarm condition is satisfied.

Although the invention has been described with reference to certain specific embodiments, various modifications thereof will be apparent to those skilled in the art without departing from the spirit and scope of the invention as outlined in the claims appended hereto.

We claim:

1. A method for detecting and indicating the presence of combustion products for triggering an alarm comprising the steps of:

a. monitoring for the presence of a combustion gas and quantifying the combustion gas;

b. monitoring for the presence of an air borne particulate matter and quantifying the air borne particulate matter;

c. measuring an ambient temperature and a quantifying a change in the ambient temperature;

d. determining if a first alarm condition has been satisfied, said first alarm condition being the quantified presence of the combustion gas exceeding a threshold combustion gas level and the quantified presence of the air borne particulate matter exceeding a first threshold air borne particulate matter level;

e. determining if a second alarm condition has been satisfied, said second alarm condition being the quantified presence of the air borne particulate matter exceeding a second threshold air borne particulate matter level, said second air borne particulate matter threshold being greater than said first air borne particulate matter threshold;

f. determining if a third alarm condition has been satisfied, said third alarm condition being the quantified change in the ambient temperature exceeding a threshold temperature change level;

g. triggering an alarm when at least one of said first, second and third alarm conditions has been satisfied.

2. The method for detecting and indicating the presence of combustion products according to claim 1, wherein the combustion gas is selected from the group consisting of CO, $CO_2$, HCN, HCl, $SO_x$, $NO_x$ and combinations thereof.

3. The method for detecting combustion according to claim 2, wherein the air borne particulate matter is smoke.

4. The method for detecting and indicating the presence of combustion products according to claim 3, wherein the combustion gas level is measured as parts per million.

5. The method for detecting and indicating the presence of combustion products according to claim 4, wherein the air borne particulate matter level is a percentage of obscuration.

6. The method for detecting and indicating the presence of combustion products according to claim 5, wherein the temperature change level is measured as at least one of degrees Fahrenheit, degrees Celsius and degrees Kelvin.

7. The method according to claim 1 further comprising the step of accounting for rate of change variances in the measured quantified change in the ambient temperature.

8. The method according to claim 7 further comprising the step of comparing an input signal of the measured quantified change in the ambient temperature to a reference value corresponding to a threshold temperature change.

9. A system for detecting and indicating the presence of combustion products for triggering an alarm comprising:

a. a combustion gas monitor for monitoring for the presence of a combustion gas and quantifying a level of the combustion gas;

b. an air borne particulate matter monitor for monitoring for the presence of an air borne particulate matter and quantifying a level the air borne particulate matter;

c. a temperature monitor for measuring an ambient temperature and quantifying a change for the ambient temperature;

d. a gas comparison stage in communication with said combustion gas monitor for receiving said quantified level of said combustion gas and generating a gas signal when a gas threshold level has been met;

e. a particulate matter comparison stage in communication with said air borne particulate matter monitor for receiving said quantified level of said air borne particulate matter and generating a particulate matter signal when a particulate matter threshold level has been met;

f. a temperature comparison stage in communication with said temperature monitor for receiving said quantified change in ambient temperature and generating a temperature change signal when a temperature change threshold has been met;

g. a combiner in communication with said gas comparison stage, particulate matter comparison stage and temperature comparison stage for receiving said gas signal, particulate matter signal and temperature change signal;

h. an alarm in communication with said combiner for triggering an alarm when an alarm condition is satisfied, said alarm condition being at least one of:

i. the quantified presence of the combustion gas exceeding a threshold combustion gas level and the quantified presence of the air borne particulate matter exceeding a first threshold air borne particulate matter level;

ii. the quantified presence of the air borne particulate matter exceeding a second threshold air borne particulate matter level, said second air borne particulate matter threshold being greater than said first air borne particulate matter threshold; and, iii. the quantified change in the ambient temperature exceeding a threshold temperature change level.

10. The system for detecting and indicating the presence of combustion products according to claim 9, wherein the combustion gas is selected from the group consisting of CO, $CO_2$, HCN, HCl, $SO_x$, $NO_x$ and combinations thereof.

11. The system for detecting and indicating the presence of combustion products according to claim 10, wherein the air borne particulate matter is smoke.

12. The system for detecting and indicating the presence of combustion products according to claim 11, wherein the combustion gas monitor is a micro-electronic gas sensor.

13. The system for detecting and indicating the presence of combustion products according to claim 12, wherein the air borne particulate matter monitor is a photo-electric particle detector.

14. The system for detecting and indicating the presence of combustion products according to claim 13, wherein the temperature monitor is a thermister.

15. The system according to claim 9, wherein rate of change variances are accounted for in the measured quantified change of the ambient temperature.

16. The method according to claim 15, wherein an input signal of the measured quantified change in the ambient temperature is compared to a reference value corresponding to a threshold temperature change.

17. An apparatus for detecting and indicating the presence of combustion products for triggering an alarm comprising:

a. a combustion gas monitor for monitoring for the presence of a combustion gas and quantifying a level of the combustion gas;

b. an air borne particulate matter monitor for monitoring for the presence of an air borne particulate matter and quantifying a level the air borne particulate matter;

c. a temperature monitor for measuring an ambient temperature and quantifying a change in the ambient temperature;

d. a gas comparison stage connected to said combustion gas monitor for receiving said quantified level of said combustion gas and generating a gas signal when a gas threshold level has been met;

e. a particulate matter comparison stage connected to said air borne particulate matter monitor for receiving said quantified level of said air borne particulate matter and generating a particulate matter signal when a particulate matter threshold level has been met;

f. a temperature comparison stage connected to said temperature monitor for receiving said quantified change in ambient temperature and generating a temperature change signal when a temperature change threshold has been met;

g. a combiner connected to said gas comparison stage, particulate matter comparison stage and temperature comparison stage for receiving said gas signal, particulate matter signal and temperature change signal;

h. an alarm connected to said combiner for triggering an alarm when an alarm condition is satisfied, said alarm condition being at least one of:

i. the quantified presence of the combustion gas exceeding a threshold combustion gas level and the quantified presence of the air borne particulate matter exceeding a first threshold air borne particulate matter level;

ii. the quantified presence of the air borne particulate matter exceeding a second threshold air borne particulate matter level, said second air borne particulate matter threshold being greater than said first air borne particulate matter threshold; and, iii. the quantified change in the ambient temperature exceeding a threshold temperature change level.

18. The apparatus for detecting and indicating the presence of combustion products according to claim 17, wherein the combustion gas is selected from the group consisting of CO, $CO_2$, HCN, HCl, $SO_x$, $NO_x$ and combinations thereof.

19. The apparatus for detecting and indicating the presence of combustion products according to claim 18, wherein the air borne particulate matter is smoke.

20. The apparatus for detecting and indicating the presence of combustion products according to claim 19, wherein the combustion gas monitor is a micro-electronic gas sensor.

21. The apparatus for detecting and indicating the presence of combustion products according to claim 20, wherein the air borne particulate matter monitor is a photo-electric particle detector.

22. The apparatus for detecting and indicating the presence of combustion products according to claim 21, wherein the temperature monitor is a thermister.

23. The apparatus according to claim 17, wherein rate of change variances are accounted for in the measured quantified change of the ambient temperature.

24. The method according to claim 23, wherein an input signal of the measured quantified change in the ambient temperature is compared to a reference value corresponding to a threshold temperature change.

* * * * *